US011186414B2

(12) United States Patent
Finch

(10) Patent No.: US 11,186,414 B2
(45) Date of Patent: Nov. 30, 2021

(54) TAMPER-PROOF CAP AND SPOUT AND METHODS RELATED THERETO

(71) Applicant: Paharpur 3P, Ghaziabad (IN)

(72) Inventor: Craig Edward Finch, Toledo, OH (US)

(73) Assignee: PAHARPUR 3P, Ghaziabad (IN)

( * ) Notice: Subject to any disclaimer, the term of this patent is extended or adjusted under 35 U.S.C. 154(b) by 200 days.

(21) Appl. No.: 16/481,563

(22) PCT Filed: Jan. 31, 2018

(86) PCT No.: PCT/IB2018/050592
§ 371 (c)(1),
(2) Date: Jul. 29, 2019

(87) PCT Pub. No.: WO2018/142294
PCT Pub. Date: Aug. 9, 2018

(65) Prior Publication Data

US 2020/0239198 A1 Jul. 30, 2020

(30) Foreign Application Priority Data

Feb. 1, 2017 (IN) ..... 201711003721

(51) Int. Cl.
*B65D 41/34* (2006.01)
*B65D 50/00* (2006.01)
*B65D 75/58* (2006.01)

(52) U.S. Cl.
CPC ..... *B65D 41/3409* (2013.01); *B65D 50/00* (2013.01); *B65D 75/5883* (2013.01); *B65D 2401/30* (2020.05)

(58) Field of Classification Search
CPC .... B65D 43/0235; B65D 5/746; B65D 5/745; B65D 5/743; B65D 5/742; B65D 5/74;
(Continued)

(56) References Cited

U.S. PATENT DOCUMENTS 3,186,450 A * 6/1965 Beall ..... A61J 1/2089 141/319
4,614,437 A * 9/1986 Buehler ..... B01F 13/002 141/319

(Continued)

*Primary Examiner* — Kareen K Thomas
(74) *Attorney, Agent, or Firm* — Fay Sharpe LLP

(57) ABSTRACT

A cap (10) configured to interact with a spout (12), said cap (10) comprising: a proximal section (14), a distal section (16), a sidewall section (18) in between said proximal (14) and distal section (16); at least two rotating means (20) attached to said sidewall (18) wherein said rotating means (20) configured to be attached to a first tamper proof indicator; at least one cutting element (22) configured in the proximal section (14) of said cap (10) arranged to remove a second tamper proof indicator (24) provided in said spout (12); wherein said cap (10) is arranged such that said first tamper proof indicator is arranged to break or open before said second tamper proof indicator (24) of said spout (12) is removed when said cap (10) is being unscrewed from said spout (12). A spout (12) configured to interact with a cap (10), said spout (12) comprising: a neck (26) provided with a second tamper proof indicator (24) extending radially outside said neck (26) such that a membrane projection is formed; wherein said second tamper proof indicator (24) arranged to be separated from the neck (26) when said cap (10) is unscrewed.

10 Claims, 9 Drawing Sheets

(58) Field of Classification Search
CPC ..... B65D 41/00–3409; B65D 50/00; B65D 75/00–5883; B65D 2401/00–30
See application file for complete search history.

(56) References Cited

U.S. PATENT DOCUMENTS

| | | | | | |
|---|---|---|---|---|---|
| 5,072,762 | A * | 12/1991 | Jimenez | B65D 51/222 | 141/329 |
| 5,316,058 | A * | 5/1994 | Spektor | B65D 47/36 | 141/309 |
| 5,505,235 | A * | 4/1996 | Gorokhovsky | B65D 47/36 | 141/319 |
| 6,098,845 | A * | 8/2000 | Stern | B65D 75/5877 | 222/83 |
| 6,129,228 | A * | 10/2000 | Adams | B65D 5/746 | 215/45 |
| 7,077,278 | B2 * | 7/2006 | Dubach | B65D 41/3409 | 215/252 |
| 7,413,097 | B1 * | 8/2008 | Adams | B65D 5/746 | 215/251 |
| 2001/0015355 | A1 * | 8/2001 | Adams | B65D 5/746 | 220/258.2 |

* cited by examiner

TAMPER-PROOF CAP AND SPOUT AND METHODS RELATED THERETO

FIELD OF THE INVENTION

The invention generally relates to the field of packaging technology and tamper evident spout type dispensing packages. More particularly, the invention relates to a cap with a tamper evidence, a spout arranged to interact with the cap provided with tamper proof indicators, a package provided with the spout, a method for applying the cap onto the spout and a method for packaging liquid/solid food or other consumer items in a package and to making a package's spout tamper evident, whereby a visual indication is given as to whether or not the package has previously been opened.

BACKGROUND OF THE INVENTION

Most if not all packaged consumables marketed today at retail, including those in bottles and dispensers, contain a tamper evident device of some sort that enables a purchaser of those articles to determine if someone else previously opened and re-closed the package. If nothing else, due to the presence of that visible feature, the purchaser gains confidence that a miscreant has not tampered with the purity or amount of the packaged product and feels assured of the product's integrity.

Moreover, food safety is a major concern throughout the world. In order to be sure that food produced and packaged in one place and consumed in another place are safe to consume, the food must be packed in hygienic conditions in packages capable of keeping these conditions until the packages are opened. Thus, there is a need to know if the packages have been opened or not.

There are several tamper-proof spout and caps available in the market. Some caps have tamper proof rings that break on opening but could be easily replaced by screwing the cap in opposite direction.

In order to be able to know if a package has been opened or not so-called tamper evidence solutions have been developed. For instance, it is known to provide bottles with tamper rings attached to the caps. Most often the tamper rings are made as parts of the caps, more particularly the lowermost parts of the caps. Further, in order to make it possible to separate the caps from the tamper rings weakening lines are made between the caps and the tampering rings. The spouts, on the other hand, are provided with tamper flanges in order to make the tamper rings stay on the spouts when the caps are unscrewed.

Although the tamper evidence solutions of today are safe there is still a need for even safer tamper evidence solutions.

OBJECTS OF THE INVENTION

To address the aforesaid drawbacks, the present invention relates to a cap with a tamper evidence and a spout and methods related thereto.

A primary object of the invention is to provide tamper proof indicators for a package.

Another further object of the invention is to provide a tamper evident spouted package with a tamper proof indicator that cannot be defeated.

SUMMARY OF THE INVENTION

The present invention satisfies the objects described above by providing a cap with a tamper evidence and a spout arranged to interact with the cap provided with tamper proof indicators.

It has been found that by having a cap provided with a first tamper proof indicator arranged to be separated before the cap is unscrewed off a spout comprising a neck provided with a second tamper proof indicator arranged to be separated from the neck when the cap is unscrewed, two different processes are performed when the cap is unscrewed. Since the product of the package is kept safely as long as the second tamper proof indicator is not separated from the neck, the cap and spout can be arranged such that the first tamper proof indicator is separated from the cap before the second tamper proof indicator is separated from the neck, that is the process of separating the first tamper proof indicator from the cap is arranged to be performed before the process of separating the second tamper proof indicator from the neck. This has the advantage that a very reliable tamper evidence is achieved giving confidence to the purchaser in the purity or amount of the packaged product and the purchaser feels assured of the product's integrity.

The package of the invention can be used for packaging of products including fluid such as liquids (e.g. beverages), solids (e.g. pieces, powdered or granular etc.) or semi-solids (e.g. pastes, creams or gels etc.) food or non-food products or the like.

Apart from having good food safety properties it is important that the indication that the food or consumer item is safe to consume, or use is truly reliable. More particularly, it is important that the good food safety properties remain as long as the tamper element is attached to the cap. Therefore, by adapting the cap such that a first tamper proof indicator attached to the cap is broken/removed before the second tamper proof indicator of the spout is cut off the indication that the food or consumer item is safe to consume is truly valid since the package is closed as long as the tamper proof indicators are fully attached to the cap.

According to a first aspect a cap is provided. The cap is arranged to interact with a spout. The cap comprises a proximal section and a distal section, a side wall section in between, at least two rotating means attached to said side wall section which assist in the cap removal, said rotating means may be used for sealing to a film bag or package which provide first tamper proof indicator including a tearing interface provided with a weakening line in said film bag or package, said weakening line arranged to break or open exposing the cap such that said first tamper proof indicator is removed or is separated from said side wall section, at least one resilient cutting element arranged in the proximal section of the cap, said at least one resilient cutting element arranged to remove a second tamper proof indicator of said spout when said cap is unscrewed, wherein said cap is arranged such that said weakening line is arranged to break or open before said second tamper proof indicator of said spout is removed when said cap is unscrewed from said spout.

The resilient cutting element of the cap, not being limited to, includes a displacement cog that is configured to contact and remove the second tamper proof indicator.

The rotating means, not being limited to, include tabs or fins attached to said side wall section which assist in the cap removal.

In one of the embodiments, the cap is without rotating means.

The second tamper proof indicator, not being limited to, may be a membrane or a tamper ring.

The upper portion of the cap is splined for additional grip. The interior wall of the cap has a molded thread for mating with the spout. The interior of the cap has a two wall sealing area that forms around to a tubular top covering the spout.

According to a second aspect a spout arranged to interact with a cap is provided. The spout comprises a neck provided with a second tamper proof indicator such as a membrane arranged to be separated from the neck when the cap is unscrewed, the said neck is attached to said second tamper proof indicator in a cut off area, said second tamper proof indicator extending radially outside said neck such that a membrane projection is formed, said membrane projection arranged to direct at least one resilient cutting element of said cap radially inwards when said cap is unscrewed such that said second tamper proof indicator can be separated from said neck. The second tamper proof indictor is connected to the neck of the spout by one or more break away tabs that are separated by the resilient cutting element of the cap when the cap is unscrewed.

The spout is arranged such that said first tamper proof indicator is separated from said cap before said second tamper proof indicator is separated from said neck when said cap is being unscrewed from said spout.

The spout has an opening that allows for filling and dispensing the consumer item packaged in the package. The neck of the spout is provided with a mating cap thread which interacts with the molded thread of the cap.

One or more thin flange is provided in a proximal section of the spout with a surface conducive for heat sealing to the interior walls of a package for example a film bag.

The cap and spout may be made of any material including High Density Poly Ethylene (HDPE) or polypropylene which can also be blended with Low Density Poly Propylene (LDPE).

An advantage of having the spout and cap made of HDPE is that the shelf life of the consumer item for example a liquid food stored in a package provided with the spout may be prolonged since the liquid food is less affected by the outside conditions due to the more resistant material in the spout. More particularly, a spout made of HDPE has a lower Oxygen Transmission Rate (OTR) than, for instance, a spout made of Low Density Poly Propylene (LDPE), which has the positive effect that less oxygen will enter the package or bottle provided with the spout through the spout, which in turn has the effect that the liquid food in the package or bottle may be stored for a longer period of time without being unsafe to consume.

Another advantage of having a spout made of HDPE is that a more robust package is achieved having the effect that more packages or bottles provided with spouts made of HDPE can be piled on top of each other.

According to a third aspect a package is provided. The package comprises a cap according to the first aspect and a spout according to the second aspect. The package may comprise a body section made of carton-based laminate or a flexible laminate, and a top section made of plastics, said top section comprising said spout.

According to a fourth aspect a method for applying a cap according to the first aspect to a spout according to the second aspect is provided. The method comprises applying said cap onto said spout such that said at least one resilient cutting element of said cap is an engaging arrangement with said second tamper proof indictor of the spout.

According to a fifth aspect a method for packaging a consumer item such as liquid food in a package according to the third aspect is provided. The method comprising forming a body portion of said package in the form of a sleeve of a carton-based laminate, forming a top section of said package, said top section comprising a spout according the second aspect, joining said top section to said body portion, filling said package with liquid food via an open end of said package, sealing said open end of said package, and applying a cap according to the first aspect onto said spout according to the fourth aspect.

Thus, the invention relates to a cap configured to interact with a spout, said cap comprising: a proximal section, a distal section, a sidewall section in between said proximal and distal section; at least two rotating means attached to said sidewall wherein said rotating means configured to be attached to a first tamper proof indicator; at least one cutting element configured in the proximal section of said cap arranged to remove a second tamper proof indicator provided in said spout; wherein said cap is arranged such that said first tamper proof indicator is arranged to break or open before said second tamper proof indicator of said spout is removed when said cap is being unscrewed from said spout.

The present invention further relates to a spout configured to interact with a cap, said spout comprising: a neck provided with a second tamper proof indicator extending radially outside said neck such that a membrane projection is formed; wherein said second tamper proof indicator arranged to be separated from the neck when said cap is unscrewed.

BRIEF DESCRIPTION OF THE ACCOMPANYING DRAWINGS

The above, as well as additional objects, features and advantages of the present invention, will be better understood through the following illustrative and non-limiting description of preferred embodiments of the present invention, with reference to the appended drawings, wherein.

DETAILED DESCRIPTION OF THE INVENTION

As summarized above, the present invention encompasses a providing a cap with a tamper evidence and a spout arranged to interact with the cap provided with tamper proof indicators and methods related thereto.

While this invention is susceptible of embodiments in many different forms, there will be described herein specific embodiments with the understanding that the present disclosure is to be considered as an exemplification of the principles of the invention and is not intended to limit the invention to the embodiments detailed herein.

As used herein, the term "proximal" refers to a region of the cap or a location on the cap which is closest to, for example, a purchaser using the cap. In contrast to this, the term "distal" refers to a region of the cap which is farthest from the purchaser, for example, the proximal region of the cap will be the region of the cap containing the displacement cog that is configured to contact and remove the second tamper proof indicator.

Figure 1A:
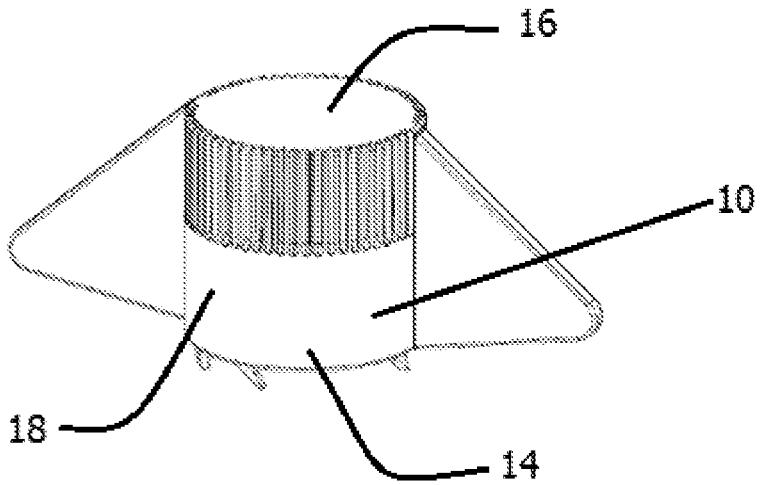
FIGS. 1A, 1B, 1C, 1D and 1E illustrate a cap according one of the embodiments of the present invention.
Figure 1B:
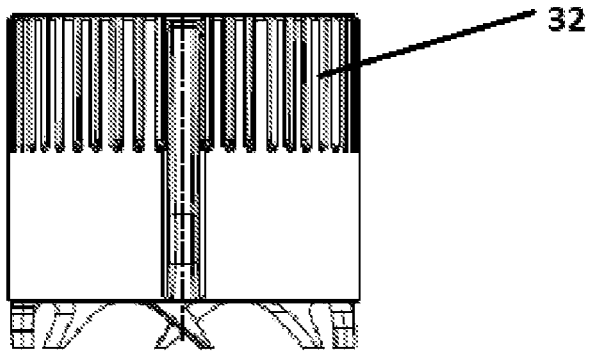
Figure 1C:
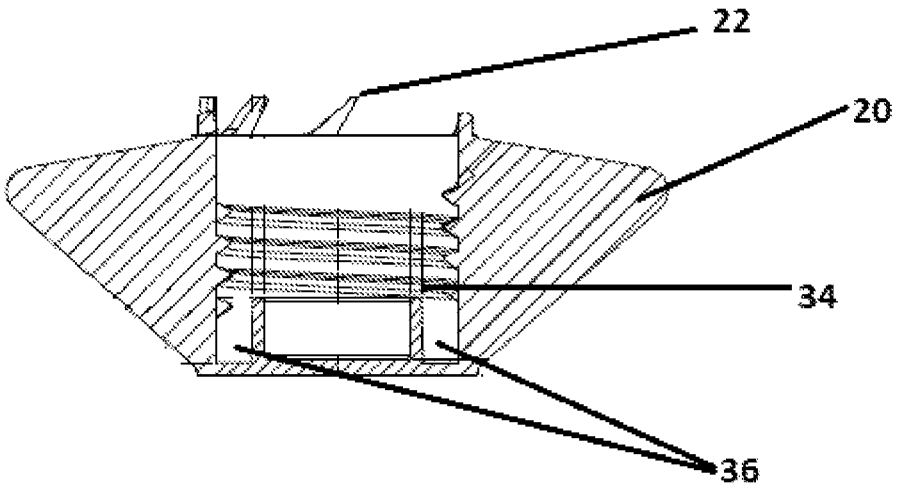
Figure 1D:
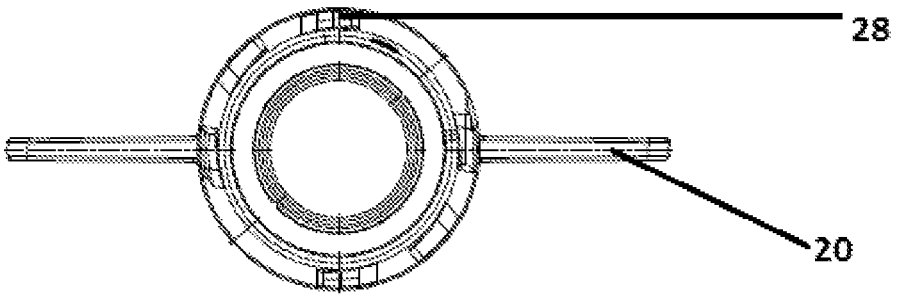
Figure 1E:
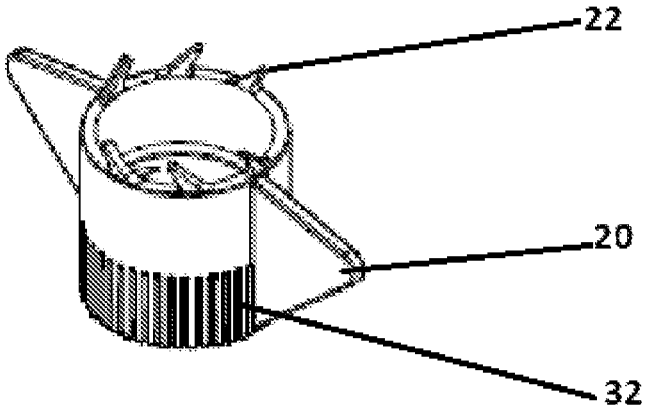
Figure 2A:
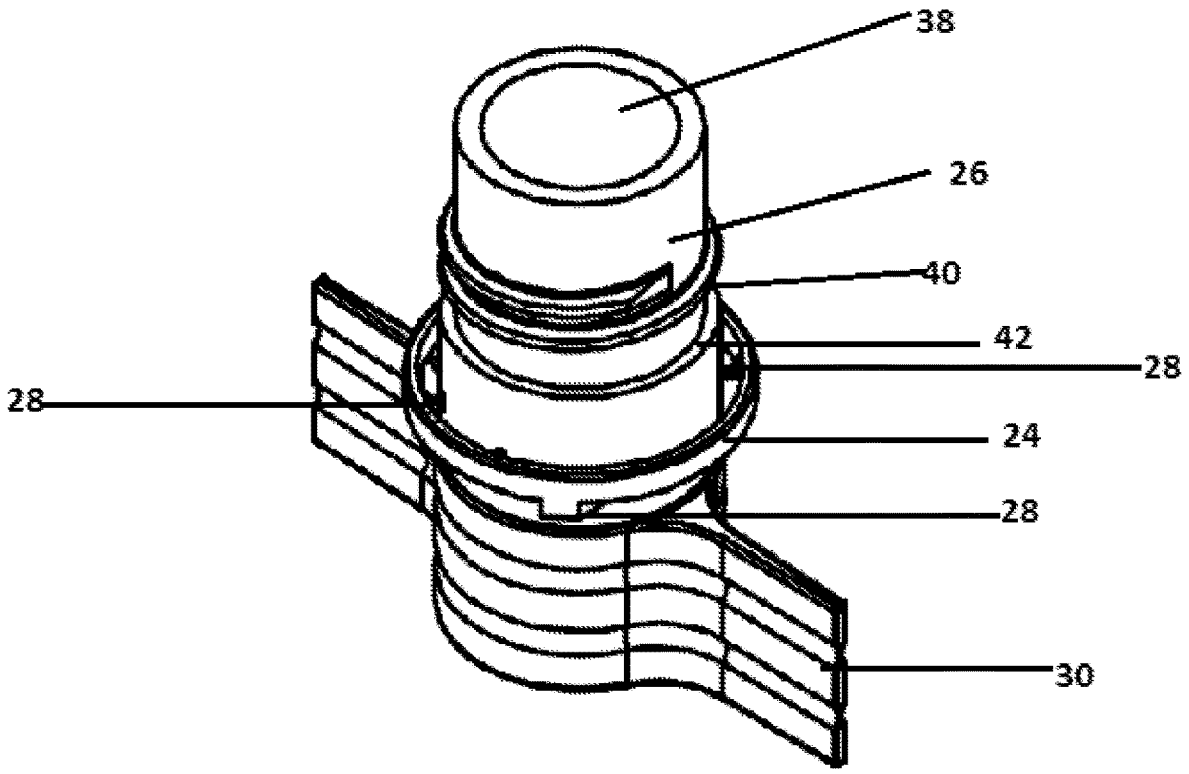
FIGS. 2A, 2B and 2C illustrate a spout according to according one of the embodiments of the present invention.
Figure 2B:
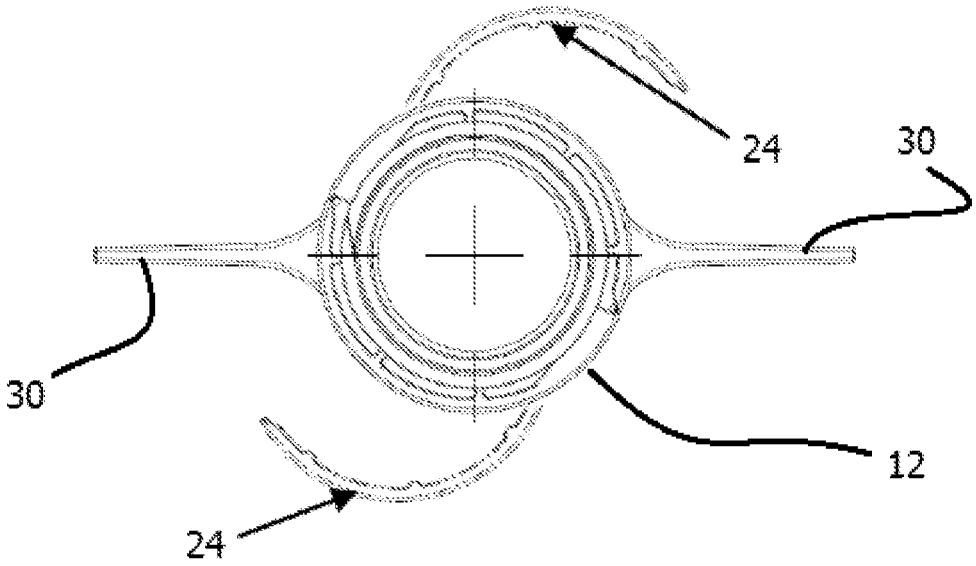
Figure 2C:
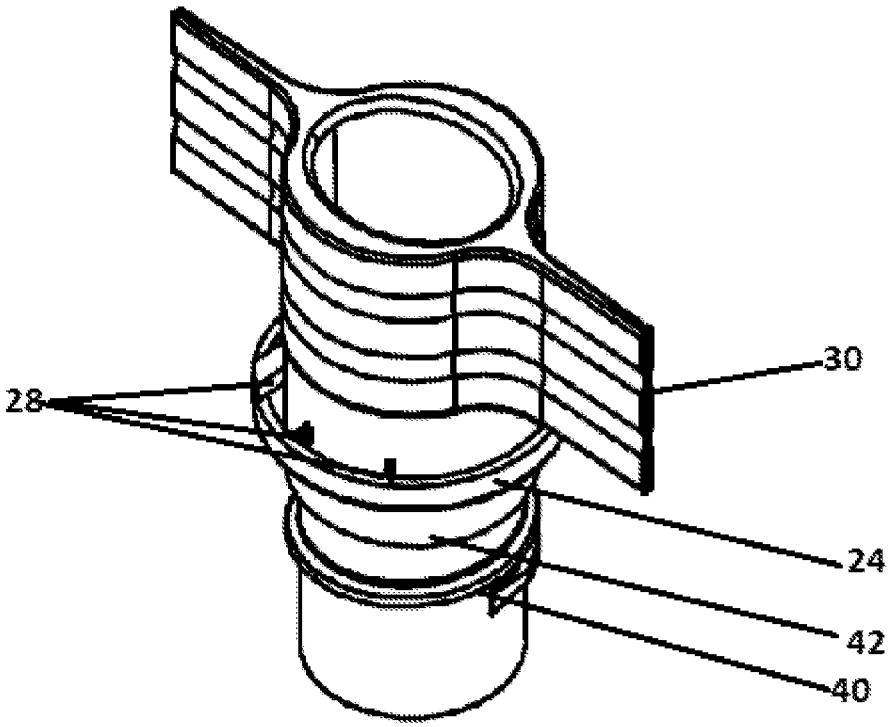
Figures 3A, 3B:
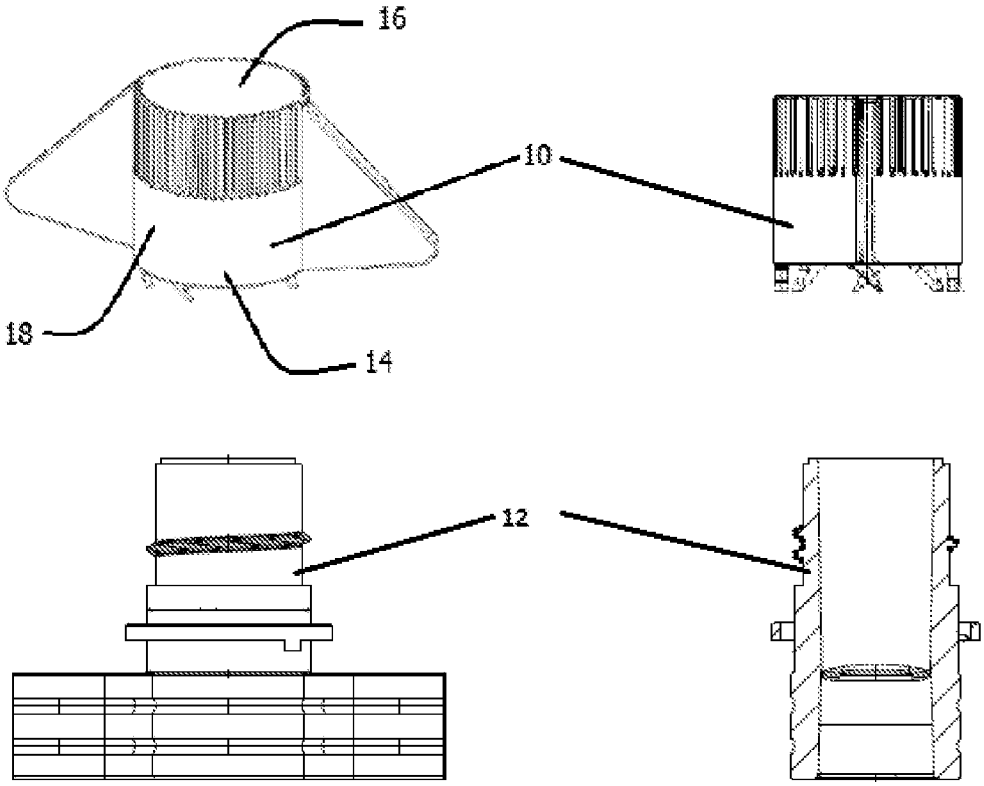
FIGS. 3A and 3B illustrate a cap and spout according one of the embodiments of the present invention.
Figure 4A:
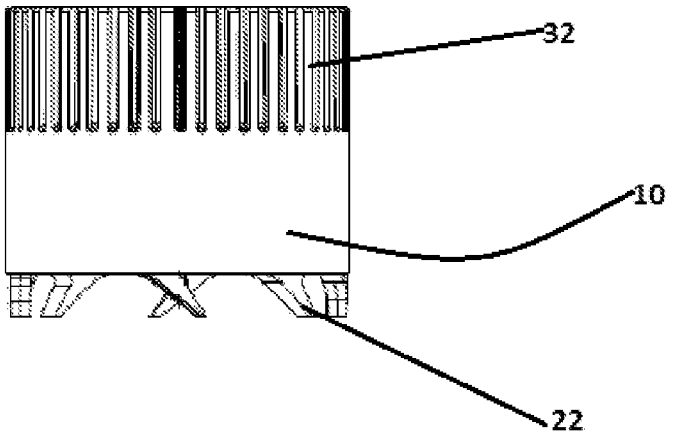
FIGS. 4A, 4B, 4C and 4D illustrate a cap according to one of the embodiments of the present invention.
Figure 4B:
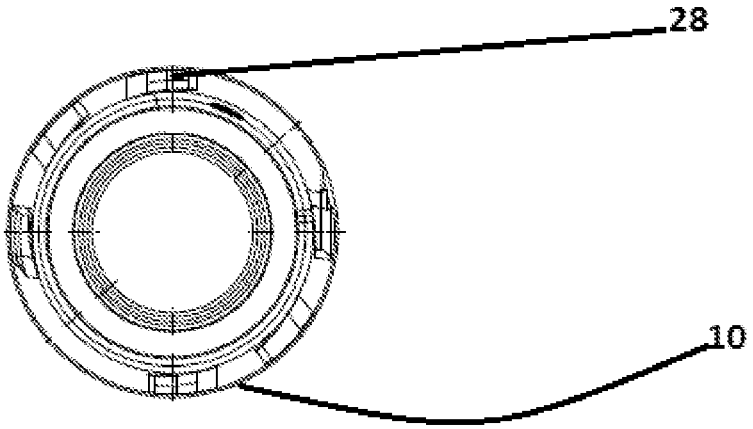
Figure 4C:
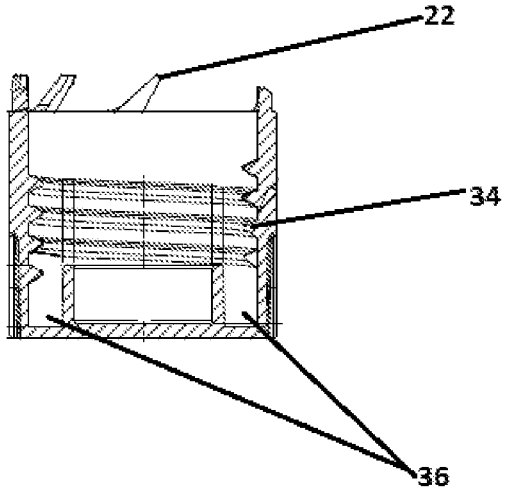
Figure 4D:
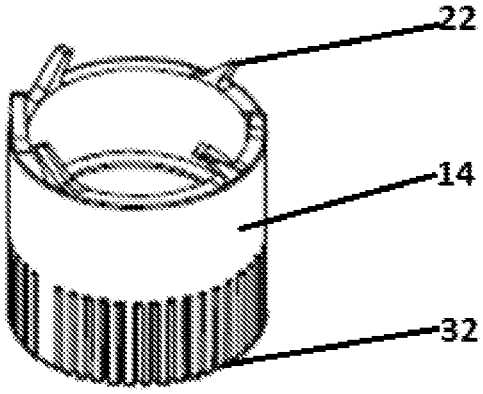

Referring to FIGS. 1A-D, 2A-B, 3A-B, and 4A-D a cap 10 is provided which is arranged to interact with a spout 12. The cap 10 comprises a proximal section 14 and a distal section 16, a side wall section 18 in between, at least two rotating means 20 attached to said side wall section 18 which assist in the cap 10 removal, said rotating means 20 may be used for sealing to a film bag (not shown) which provide first tamper proof indicator (not shown) including a tearing interface provided with a weakening line in said film bag, said weakening line arranged to break or open exposing the cap 10 such that said first tamper proof indicator is removed or is separated from said side wall section 18, at least one resilient cutting element 22 arranged in the proximal section 14 of the cap 10, said at least one resilient cutting element 22 arranged to remove a second tamper proof indicator 24 of said spout 12 when said cap 10 is unscrewed, wherein said cap 10 is arranged such that said weakening line is arranged to break or open before said second tamper proof indicator 24 of said spout 12 is removed when said cap 10 is unscrewed from said spout 12.

The spout 12 comprises a neck 26 provided with a second tamper proof indicator 24 such as a membrane arranged to be separated from the neck 26 when the cap 10 is unscrewed, the said neck 26 is attached to said second tamper proof indicator 24 in a cut off area, said second tamper proof indicator 24 extending radially outside said neck 26 such that a membrane projection is formed, said membrane projection arranged to direct at least one resilient cutting element 22 of said cap 10 radially inwards when said cap 10 is unscrewed such that said second tamper proof indicator 24 can be separated from said neck 26. The second tamper proof indictor 24 is connected to the neck 26 of the spout 12 by one or more break away tabs 28 that are separated by the resilient cutting element 22 of the cap 10 when the cap 10 is unscrewed.

The broken second tamper proof indicator 24 i.e. membrane serves as visual evidence that the package (not shown) has been opened. Even though the spout is re-closed, the membrane 24 remains broken and the visual evidence remains. Since the cap cannot be removed without either breaking the membrane 24 or destroying the closure entirely, the foregoing tamper evident feature is defeat proof.

One or more thin flange 30 is provided in a proximal section 14 of the spout 12 with a surface conducive for heat sealing to the interior walls of a package (not shown) for example a film bag.

The upper portion of the cap 10 is splined for additional grip 32. The interior wall of the cap 10 has a molded thread 34 for mating with the spout 12. The interior of the cap 10 has a two wall sealing area 36 that forms around to a tubular top covering the spout 12.

The spout 12 has an opening 38 that allows for filling and dispensing the consumer item packaged in the package. The neck 26 of the spout 12 is provided with a mating cap thread 40 which interacts with the molded thread 34 of the cap 10.

The spout 12 is arranged such that said first tamper proof indicator is separated from said cap 10 before said second tamper proof indicator 24 is separated from said neck 26 when said cap 10 is being unscrewed from said spout 12.

Although, the invention has been described with reference to certain specific embodiments and examples, it would be appreciated by those skilled in the art that the invention may be embodied in many forms without departing from the broader spirit and scope of the invention as set forth in the invention. Thus, variations of preferred embodiments as disclosed may become apparent to those of ordinary skill in the art upon reading the foregoing description.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. The specification and drawings, therefore, are to be regarded in an illustrative rather than a restrictive manner without departing from the spirit and scope of the invention, the invention resides in the claims hereinafter appended.

LIST OF REFERENCE NUMERALS

10 cap
12 spout
14 proximal section
16 distal section
18 side wall section
20 rotating means/tabs/fins
22 resilient cutting element/displacement cogs
24 second tamper proof indicator/membrane/tamper ring
26 neck
28 break away tabs
30 thin flange
32 grip
34 molded thread
36 two wall sealing area
38 opening
40 mating cap thread
42 neck

What is claimed is:

1. A cap (10) configured to interact with a spout (12), said cap (10) comprising:

a proximal section (14), a distal section (16), a sidewall section (18) in between said proximal (14) and distal section (16);

at least two rotating means (20) attached to said sidewall (18) wherein said rotating means (20) configured to be attached to a first tamper proof indicator;

at least one cutting element (22) configured in the proximal section (14) of said cap (10) arranged to remove a second tamper proof indicator (24) provided in said spout (12);

wherein said cap (10) is arranged such that said first tamper proof indicator is arranged to break or open before said second tamper proof indicator (24) of said spout (12) is removed when said cap (10) is being unscrewed from said spout (12).

2. The cap (10) as claimed in claim 1, wherein said first tamper proof indicator includes a tearing interface provided with a weakening line in a package.

3. The cap (10) as claimed in claim 2, wherein said weakening line is arranged to break or open exposing said cap (10).

4. The cap (10) as claimed in claim 1, wherein the interior wall of said cap has a molded thread (34) for mating with said spout (12).

5. The cap (10) as claimed in claim 1, wherein upper portion of the cap is splined providing additional grip (32).

6. The spout (12) as claimed in claim 1, wherein said spout (12) arranged such that said first tamper proof indicator is separated from said cap (10) before said second tamper proof indicator (24) is separated from said neck (26) when said cap (10) is being unscrewed from said spout (12).

7. The spout (12) as claimed in claim 2, wherein said spout (12) arranged such that said first tamper proof indicator is separated from said cap (10) before said second tamper proof indicator (24) is separated from said neck (26) when said cap (10) is being unscrewed from said spout (12).

8. The spout (12) as claimed in claim 3, wherein said spout (12) arranged such that said first tamper proof indicator is separated from said cap (10) before said second tamper proof indicator (24) is separated from said neck (26) when said cap (10) is being unscrewed from said spout (12).

9. The spout (12) as claimed in claim 4, wherein said spout (12) arranged such that said first tamper proof indicator is separated from said cap (10) before said second tamper proof indicator (24) is separated from said neck (26) when said cap (10) is being unscrewed from said spout (12).

10. The spout (12) as claimed in claim 5, wherein said spout (12) arranged such that said first tamper proof indicator is separated from said cap (10) before said second tamper proof indicator (24) is separated from said neck (26) when said cap (10) is being unscrewed from said spout (12).

* * * * *